US011761668B2

(12) United States Patent
Lee et al.

(10) Patent No.: US 11,761,668 B2
(45) Date of Patent: Sep. 19, 2023

(54) COOLING SYSTEM USING EJECTOR AND MEMBRANE

(71) Applicant: KOREA INSTITUTE OF ENERGY RESEARCH, Daejeon (KR)

(72) Inventors: Beom Joon Lee, Sejong-si (KR); Gil-bong Lee, Daejeon (KR); Chulwoo Roh, Sejong-si (KR); Young-jin Baik, Daejeon (KR); Hyung-ki Shin, Sejong-si (KR); Jong Jae Cho, Sejong-si (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 67 days.

(21) Appl. No.: 17/509,547

(22) Filed: Oct. 25, 2021

(65) Prior Publication Data

US 2022/0128260 A1 Apr. 28, 2022

(30) Foreign Application Priority Data

Oct. 26, 2020 (KR) ..... 10-2020-0139376

(51) Int. Cl.
*F24F 12/00* (2006.01)
*F24F 3/147* (2006.01)
(Continued)

(52) U.S. Cl.
CPC ..... *F24F 12/006* (2013.01); *F24F 3/147* (2013.01); *F25B 9/08* (2013.01); *F28D 21/0015* (2013.01);
(Continued)

(58) Field of Classification Search
CPC ..... F24F 12/006; F24F 3/147; F24F 5/0046; F24F 1/0083; F24F 3/14;
(Continued)

(56) References Cited

U.S. PATENT DOCUMENTS 1,029,201 A * 6/1912 Lablanc ..... F25B 1/08 62/347
3,731,291 A * 5/1973 Walsh ..... G11B 23/505
(Continued)

FOREIGN PATENT DOCUMENTS

JP 2604235 B2 * 4/1997 ..... F25B 1/06
KR 10-1838636 B1 3/2018

*Primary Examiner* — Travis Ruby
*Assistant Examiner* — Christopher C Pillow
(74) *Attorney, Agent, or Firm* — Birch, Stewart, Kolasch & Birch, LLP

(57) ABSTRACT

The cooling system may dehumidify and cool the indoor air by using the ejector, the ejector membrane, the evaporation chamber, and the indoor dehumidifying membrane. In addition, the coefficient of performance of the cooling system may be improved by cooling the refrigerant using evaporation latent heat generated in the evaporation chamber by the suction force of the ejector and cooling the indoor air using the refrigerant. In addition, by using solar heat to generate high-temperature and high-pressure steam and supply the generated steam to the ejector, energy use efficiency may be improved. In addition, since the temperature of the steam generated in the steam generating portion may be lowered by arranging and using the two first and second ejectors in multiple stages, energy efficiency may be further improved by reducing the consumption of the heat source required for steam generation.

18 Claims, 4 Drawing Sheets

(51) Int. Cl.
*F28D 21/00* (2006.01)
*F25B 9/08* (2006.01)
*F24F 5/00* (2006.01)

(52) U.S. Cl.
CPC ..... *F24F 5/0046* (2013.01); *F25B 2341/0015* (2013.01)

(58) Field of Classification Search
CPC ..... F24F 2003/1435; F24F 2203/02; F24F 5/0014; F24F 5/0035; F28D 21/0015; F25B 9/08; F24B 2341/0015
See application file for complete search history.

(56) References Cited

U.S. PATENT DOCUMENTS 6,001,367 A * 12/1999 Bazin ..... A61K 8/65 977/788
6,324,897 B1 * 12/2001 Schrenk ..... G01N 21/783 73/31.05
6,672,099 B1 * 1/2004 Yoshimi ..... F25B 19/00 62/467
6,708,517 B1 * 3/2004 Piao ..... B64D 13/06 62/324.1
2012/0137714 A1 * 6/2012 Roh ..... F24F 5/0014 62/235.1
2013/0251505 A1 * 9/2013 Wang ..... F25B 9/008 415/114
2013/0298766 A1 * 11/2013 Ehrenberg ..... B01D 53/268 95/52
2015/0159885 A1 * 6/2015 Dennis ..... F24D 11/003 62/238.7
2015/0184873 A1 * 7/2015 Lee ..... F24F 3/14 62/235.1
2017/0010006 A1 * 1/2017 Kim ..... F24F 3/14
2017/0248350 A1 * 8/2017 Liu ..... F25B 41/20
2017/0314806 A1 * 11/2017 Davies ..... F24F 12/002
2018/0120004 A1 5/2018 Lee et al.

* cited by examiner

COOLING SYSTEM USING EJECTOR AND MEMBRANE

CROSS-REFERENCE TO RELATED APPLICATIONS

This application claims priority under 35 U.S.C. § 119 to Korean Patent Application No. 10-2020-0139376, filed on Oct. 26, 2020, in the Korean Intellectual Property Office, the disclosure of which is incorporated herein by reference in its entirety.

TECHNICAL FIELD

The following disclosure relates to a cooling system using an ejector and a membrane, and more particularly, to a cooling system capable of cooling and dehumidifying indoor air using an ejector and a membrane.

BACKGROUND

In general, an ejector is a kind of pump that may eject water, steam, air, and the like having pressure from an outlet at high speed to transfer a surrounding fluid to another place. The ejector without a separate driving device has the advantage of a simple structure, small volume and weight, and fewer failures.

Recently, research and development on a technology for improving the coefficient of performance (COP) of a cycle by including the ejector in a refrigeration cycle is increasing.

RELATED ART DOCUMENT

Patent Document (Patent Document 1) Korean Patent No. 10-1838636

SUMMARY

An embodiment of the present invention is to provide a cooling system capable of cooling and dehumidifying indoor air using an ejector and a membrane.

In one general aspect, a cooling system using an ejector and a membrane includes: a steam generating portion for generating high-pressure steam from an external heat source; an ejector for sucking the steam discharged from the steam generating portion through a main suction port and ejecting the steam at high speed through a discharge port; an evaporation chamber connected to a sub-suction port of the ejector, water stored therein being evaporated by a suction force of the ejector and sucked into the sub-suction port; an ejector membrane provided at the discharge port of the ejector to permeate moisture discharged from the ejector due to a difference in partial pressure of moisture between a discharge side of the ejector and outside air and discharge the moisture to the outside air; an indoor unit provided in a room and sucking and cooling indoor air; and a cooling heat exchange portion provided between the evaporation chamber and the indoor unit, cooling a refrigerant by performing heat exchange between the refrigerant and water cooled by evaporation latent heat generated in the evaporation chamber, and cooling the indoor air by performing heat exchange between the refrigerant cooled in the evaporation chamber and the indoor air passing through the indoor unit.

In another general aspect, a cooling system using an ejector and a membrane includes: a steam generating portion for generating high-pressure steam from an external heat source; a first ejector for sucking the steam discharged from the steam generating portion through a first main suction port and ejecting the steam at high speed through a first discharge port; an evaporation chamber connected to a first sub-suction port of the first ejector, water stored therein being evaporated by a suction force of the first ejector and sucked into the first sub-suction port; a second ejector for sucking the steam discharged from the steam generating portion through a second main suction port, sucking the steam discharged from the first discharge port of the first ejector through a second sub-suction port, and ejecting the steam at high speed through a second discharge port; an ejector membrane provided at the second discharge port of the second ejector to permeate moisture discharged from the second ejector due to a difference in partial pressure of moisture between a discharge side of the second ejector and outside air and discharge the moisture to the outside air; an indoor unit provided in a room and sucking and cooling indoor air; and a cooling heat exchange portion provided between the evaporation chamber and the indoor unit, cooling a refrigerant by performing heat exchange between the refrigerant and water cooled by evaporation latent heat generated in the evaporation chamber, and cooling the indoor air by performing heat exchange between the refrigerant cooled in the evaporation chamber and the indoor air passing through the indoor unit.

The cooling system using an ejector and a membrane may further include an indoor dehumidifying membrane provided inside the indoor unit to permeate and discharge moisture in high-temperature and humid indoor air sucked into the indoor unit to dehumidify the indoor air.

The cooling system using an ejector and a membrane may further include a moisture discharge flow path for guiding the moisture that has permeated the indoor dehumidifying membrane to a discharge side of the evaporation chamber.

The steam generating portion may include a photovoltaic thermal (PVT) module that collects solar heat to generate steam.

The external heat source may include at least one of solar heat and geothermal heat, and the steam generating portion may include a first steam generating portion for that generating steam from the external heat source and supplying the steam to the first ejector, and a second steam generating portion for generating steam from the external heat source and supplying the steam to the second ejector.

The cooling heat exchange portion may include: a refrigerant flow path for guiding the refrigerant to circulate through the evaporation chamber and the indoor unit; a refrigerant pump provided in the refrigerant flow path to pump the refrigerant cooled by heat exchange in the evaporation chamber; a cooling heat exchanger provided in the refrigerant flow path and disposed to pass through the indoor unit to transfer cool air of the refrigerant pumped by the refrigerant pump to the indoor air passing through the indoor unit; and a refrigerant valve provided in the refrigerant flow path to control a flow rate of the refrigerant flowing into the evaporation chamber.

The indoor unit may include: a case in which the cooling heat exchanger is disposed; an intake port formed on one side of the case to suck indoor air; an exhaust port formed on the other side of the case to discharge air cooled by the cooling heat exchanger into the room; and a blowing fan for sucking the indoor air through the intake port and discharging the indoor air through the exhaust port.

The cooling system using an ejector and a membrane may further include an indoor dehumidifying membrane disposed between the intake port and the cooling heat exchanger inside the case to dehumidify the indoor air by permeating and discharging moisture in the high-temperature and humid indoor air flowing into the intake port.

The cooling system using an ejector and a membrane may further include a moisture discharge flow path for guiding the moisture that has permeated the indoor dehumidifying membrane to a discharge side of the evaporation chamber.

The cooling system using an ejector and a membrane may further include: a discharge partial pressure sensor for measuring a partial pressure of moisture discharged from the ejector; an outdoor air sensor for measuring a partial pressure of moisture in the outdoor air; and a control unit for controlling an operation of the steam generating portion so that the partial pressure of the moisture discharged from the ejector exceeds the partial pressure of the moisture in the outside air.

In still another general aspect, a cooling system using an ejector and a membrane includes: a steam generating portion for generating high-pressure steam from an external heat source; an ejector for sucking the steam discharged from the steam generating portion through a main suction port and ejecting the steam at high speed through a discharge port; an evaporation chamber connected to a sub-suction port of the ejector, water stored therein being evaporated by a suction force of the ejector and sucked into the sub-suction port; an ejector membrane provided at the discharge port of the ejector to permeate moisture discharged from the ejector due to a difference in partial pressure of moisture between a discharge side of the ejector and outside air and discharge the moisture to the outside air; an indoor unit provided in a room and sucking and cooling indoor air; a cooling heat exchange portion provided between the evaporation chamber and the indoor unit, cooling a refrigerant by performing heat exchange between the refrigerant and water cooled by evaporation latent heat generated in the evaporation chamber, and cooling the indoor air by performing heat exchange between the refrigerant cooled in the evaporation chamber and the indoor air passing through the indoor unit; an indoor dehumidifying membrane provided inside the indoor unit to permeate and discharge moisture in high-temperature and humid indoor air sucked into the indoor unit to dehumidify the indoor air; and a moisture discharge flow path for guiding the moisture that has permeated the indoor dehumidifying membrane to a sub-suction port of the first ejector, wherein the steam generating portion includes a photovoltaic thermal (PVT) module that collects solar heat to generate steam, and the cooling heat exchange portion includes a refrigerant flow path for guiding the refrigerant to circulate through the evaporation chamber and the indoor unit, a refrigerant pump provided in the refrigerant flow path to pump the refrigerant cooled by heat exchange in the evaporation chamber, a cooling heat exchanger provided in the refrigerant flow path and disposed to pass through the indoor unit to transfer cool air of the refrigerant pumped by the refrigerant pump to the indoor air passing through the indoor unit, and a refrigerant valve provided in the refrigerant flow path to control a flow rate of the refrigerant flowing into the evaporation chamber.

In still another general aspect, a cooling system using an ejector and a membrane includes: a steam generating portion for generating high-pressure steam from an external heat source; a first ejector for sucking the steam discharged from the steam generating portion through a first main suction port and ejecting the steam at high speed through a first discharge port; an evaporation chamber connected to a first sub-suction port of the first ejector, water stored therein being evaporated by a suction force of the first ejector and sucked into the first sub-suction port; a second ejector for sucking the steam discharged from the steam generating portion through a second main suction port, sucking the steam discharged from the first discharge port of the first ejector through a second sub-suction port, and ejecting the steam at high speed through a second discharge port; an ejector membrane for permeating moisture discharged from the second ejector due to a difference in partial pressure of moisture between a discharge side of the second ejector and outside air and discharging the moisture to the outside air; an indoor unit provided in a room and sucking and cooling indoor air; a cooling heat exchange portion provided between the evaporation chamber and the indoor unit, cooling a refrigerant by performing heat exchange between the refrigerant and water cooled by evaporation latent heat generated in the evaporation chamber, and cooling the indoor air by performing heat exchange between the refrigerant cooled in the evaporation chamber and the indoor air passing through the indoor unit; an indoor dehumidifying membrane provided inside the indoor unit to permeate and discharge moisture in high-temperature and humid indoor air sucked into the indoor unit to dehumidify the indoor air; and a moisture discharge flow path for guiding the moisture that has permeated the indoor dehumidifying membrane to a sub-suction port of the first ejector, wherein the steam generating portion includes a photovoltaic thermal (PVT) module that collects solar heat to generate steam, and the cooling heat exchange portion includes a refrigerant flow path for guiding the refrigerant to circulate through the evaporation chamber and the indoor unit, a refrigerant pump provided in the refrigerant flow path to pump the refrigerant cooled by heat exchange in the evaporation chamber, a cooling heat exchanger provided in the refrigerant flow path and disposed to pass through the indoor unit to transfer cool air of the refrigerant pumped by the refrigerant pump to the indoor air passing through the indoor unit, and a refrigerant valve provided in the refrigerant flow path to control a flow rate of the refrigerant flowing into the evaporation chamber.

DETAILED DESCRIPTION OF EMBODIMENTS

Hereinafter, embodiments of the present invention will be described in detail with reference to the accompanying drawings.

Figure 1:
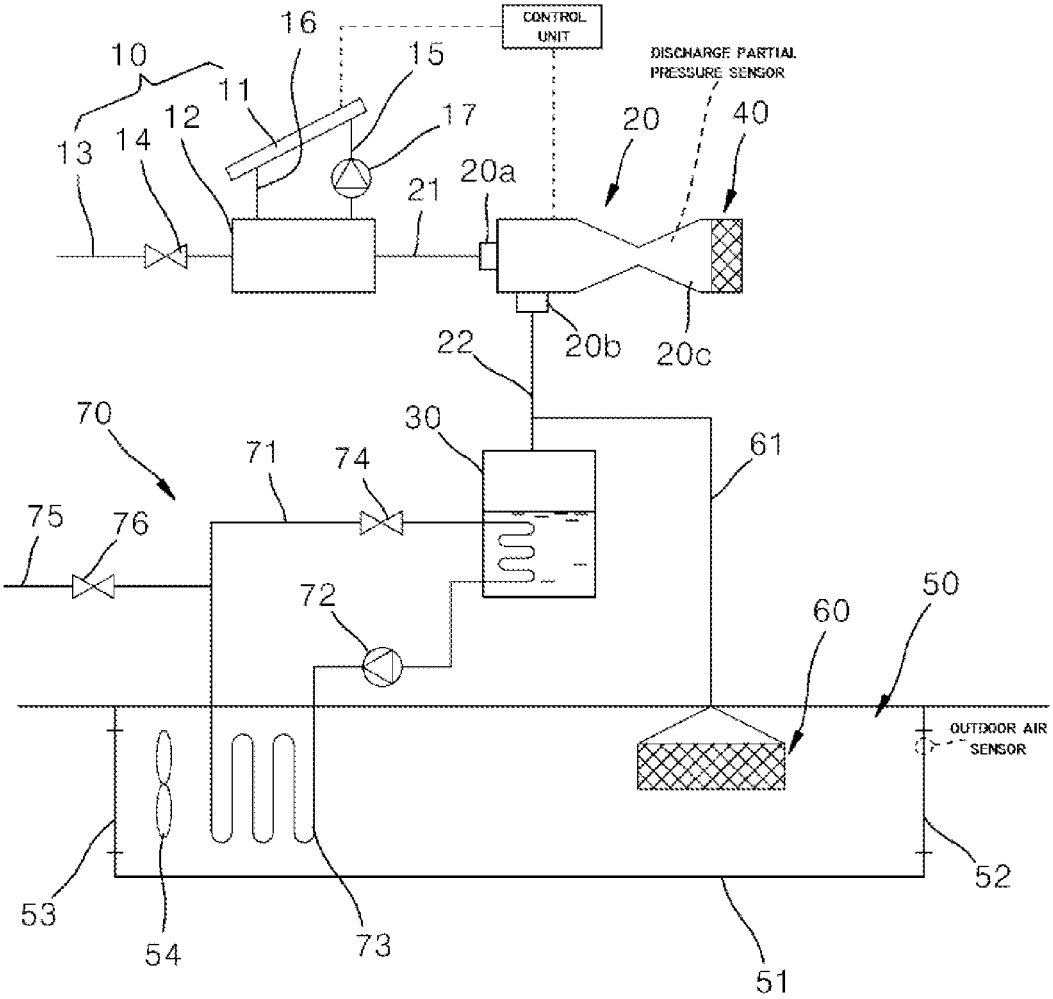
FIG. 1 is a view schematically illustrating a configuration of a cooling system using an ejector and a membrane according to a first embodiment of the present invention.

FIG. 1 is a view schematically illustrating a configuration of a cooling system using an ejector and a membrane according to a first embodiment of the present invention.

Referring to FIG. 1, a cooling system using an ejector and a membrane according to a first embodiment of the present invention includes a steam generating portion 10, an ejector 20, an evaporation chamber 30, a membrane 40 for ejector, an indoor unit 50, an indoor dehumidifying membrane 60, and a cooling heat exchange portion 70.

The steam generating portion 10 generates high-pressure steam from an external heat source. The steam generating portion 10 may generate steam by solar heat, geothermal heat, or other heat sources. In the present embodiment, an example in which the steam generating portion 10 is a photovoltaic thermal (PVT) module that generates steam by collecting solar heat will be described.

The photovoltaic thermal module includes a heat collector 11, a steam drum 12, a water supply flow path 13, and a water supply valve 14.

The heat collector 11 is a heat collecting plate that collects solar heat to generate high-temperature and high-pressure steam. The heat collector 11 and the steam drum 12 are connected by a heat collecting flow path 15 and a heat storage flow path 16.

The heat collecting flow path 15 is a flow path for guiding water stored in the steam drum 12 to the heat collector 11. The heat storage flow path 16 is a flow path for guiding the steam generated by the heat collector 11 to the steam drum 12.

A heat collecting pump 17 for pumping the water stored in the steam drum 12 to the heat collector 11 is installed in the heat collecting flow path 15.

One side of the steam drum 12 is connected to the water supply flow path 13, and the other side thereof is connected to an ejector main suction flow path 21. The steam separated from the steam drum 12 is sucked into a main suction port 20*a* of the ejector 20 through the ejector main suction flow path 21.

The water supply flow path 13 is a flow path through which water is supplied from the outside. The water supply valve 14 is installed in the water supply flow path 13.

The ejector 20 sucks the steam discharged from the steam generating portion 10 through the main suction port 20*a* and ejects the steam at high speed through a discharge port 20*c*. The ejector 20 sucks steam evaporated in the evaporation chamber 30 through a sub-suction port 20*b*.

The ejector main suction flow path 21 is connected to the main suction port 20*a* of the ejector 20, and an ejector auxiliary suction flow path 22 is connected to the sub-suction port 20*b* of the ejector 20. The ejector main suction flow path 21 is a flow path that connects the main suction port 20*a* of the ejector 20 and the steam drum 12.

The ejector auxiliary suction flow path 22 is a flow path that connects the sub-suction port 20*b* of the ejector 20 and the evaporation chamber 30.

The evaporation chamber 30 is connected to the sub-suction port 20*b* of the ejector 20 through the ejector auxiliary suction flow path 22. Water is stored in the evaporation chamber 30, and the stored water may be evaporated by a suction force of the ejector 20. In the evaporation chamber 30, a refrigerant circulating in the cooling heat exchange portion 70 may be cooled by evaporation latent heat generated when the water is evaporated.

The ejector membrane 40 is installed at the discharge port 20*c* of the ejector 20. The ejector membrane 40 permeates moisture discharged from the ejector 20 due to a difference in partial pressure of moisture between a discharge side of the ejector 20 and the outside air and discharges the moisture to the outside air. That is, the moisture may flow from the ejector 20 in an outside air direction due to a difference in partial pressure of moisture between the front and rear sides of the ejector membrane 40, and may pass through the ejector membrane 40. Any ejector membrane 40 may be used as long as it may permeate the moisture due to a difference in partial pressure of moisture.

The indoor unit 50 is provided in a room, sucks indoor air, cools the indoor air, and then discharges the indoor air to the room. The indoor unit 50 includes a case 51, an intake port 52, an exhaust port 53, and a blowing fan 54.

The case 51 forms an exterior of the indoor unit 50 and forms a space for cooling indoor air.

The intake port 52 for sucking the indoor air is formed on one side of the case 51 and the exhaust port 53 for discharging the dehumidified and cooled air inside the case to the room is formed on the other side thereof.

The blowing fan 54 is installed on the side of the intake port 52 or the exhaust port 53, and blows the indoor air in a direction from the intake port 52 toward the exhaust port 53. In the present embodiment, the blowing fan 54 is described as being installed on the side of the exhaust port 53 inside the case 51, but is not limited thereto and may also be installed outside the case 51.

The indoor dehumidifying membrane 60 is provided inside the indoor unit 50 to serve to dehumidify high-temperature and humid indoor air. The indoor dehumidifying membrane 60 is disposed between the intake port 52 and a cooling heat exchanger to be described later inside the case 51. The indoor dehumidifying membrane 60 may dehumidify indoor air by permeating and discharging moisture in the high-temperature and humid indoor air sucked through the intake port 52.

A moisture discharge flow path 61 for discharging the moisture permeated from the indoor air to the outside is connected to the indoor dehumidifying membrane 60.

The moisture discharge flow path 61 is connected to the ejector auxiliary suction flow path 22 to discharge the moisture that has permeated the indoor dehumidifying membrane 60 between the evaporation chamber 30 and the ejector 20. However, the moisture discharge flow path 61 is not limited thereto, and may also be directly connected to the sub-suction port 20*b* of the ejector 20 or directly connected to the evaporation chamber 30.

The cooling heat exchange portion 70 is provided between the evaporation chamber 30 and the indoor unit 50 and is a refrigerant cycle in which the refrigerant circulates. The cooling heat exchange portion 70 serves to cool the refrigerant in the evaporation chamber 30 and then transfer cool air of the cooled refrigerant to the indoor air passing through the indoor unit 50 to cool the indoor air. Here, the refrigerant may be water, and any other heat exchange medium may be used.

The cooling heat exchange portion 70 includes a refrigerant flow path 71, a refrigerant pump 72, a cooling heat exchanger 73, and a refrigerant valve 74.

The refrigerant flow path 71 is a flow path for guiding the refrigerant to circulate through the evaporation chamber 30 and the cooling heat exchanger 73 provided in the indoor unit 50.

The refrigerant flow path 71 is formed to pass through the evaporation chamber 30 to perform heat exchange between the water stored in the evaporation chamber 30 and the refrigerant.

The refrigerant pump 72 is provided on the side discharged from the evaporation chamber 30 in the refrigerant flow path 71, and pumps the refrigerant cooled by heat exchange in the evaporation chamber 30.

The cooling heat exchanger 73 is provided in the refrigerant flow path 71 and is disposed to pass through the inside of the indoor unit 50 to perform heat exchange between the refrigerant and the indoor air. The cooling heat exchanger 73 transfers the cool air of the refrigerant pumped by the refrigerant pump 72 to the indoor air passing through the indoor unit 50. The cooling heat exchanger 73 is disposed between the indoor dehumidifying membrane 60 and the exhaust port 53 inside the case 51. The cooling heat exchanger 73 is described as an example of a cooling coil, but is not limited thereto, and any one capable of exchanging heat between the refrigerant and the indoor air is applicable.

The refrigerant valve 74 is a valve provided in the refrigerant flow path 71 to control a flow rate of the refrigerant flowing into the evaporation chamber 30.

In addition, a refrigerant supply flow path 75 through which refrigerant is supplied from the outside is connected to the refrigerant flow path 71. A refrigerant supply valve 76 is installed in the refrigerant supply flow path 75.

In addition, the cooling system further includes a discharge partial pressure sensor (not illustrated) for measuring a partial pressure P1 of moisture discharged from the ejector 20, an outdoor air sensor (not illustrated) for measuring a partial pressure P2 of moisture in the outdoor air, and a control unit (not illustrated) for controlling an operation of the steam generating portion according to a partial pressure difference between the moisture discharged from the ejector 20 and the moisture in the outside air.

The discharge partial pressure sensor (not illustrated) is installed inside the discharge port 20*c* of the ejector 20 to measure the partial pressure P1 of moisture before being discharged from the ejector 20.

The outdoor air sensor (not illustrated) may measure a dry-bulb temperature or a wet-bulb temperature of the outdoor air, and measure the partial pressure P2 of moisture in the outdoor air using the dry-bulb temperature or the wet-bulb temperature.

The control unit (not illustrated) controls the steam generating portion 10 so that the partial pressure P1 of moisture discharged from the ejector 20 is greater than the partial pressure P2 of moisture in the outside air.

That is, the control unit (not illustrated) controls the operation of the heat collecting pump 17 to reduce the flow rate of water flowing into the heat collector 11, thereby increasing the temperature and pressure of the steam heated in the heat collector 11.

In addition, the control unit (not illustrated) controls the operation of the refrigerant pump 72, the refrigerant valve 74, and the blowing fan 54.

An operation of the cooling system using the ejector and the membrane according to the first embodiment of the present invention configured as described above will be described as follows.

Figure 2:
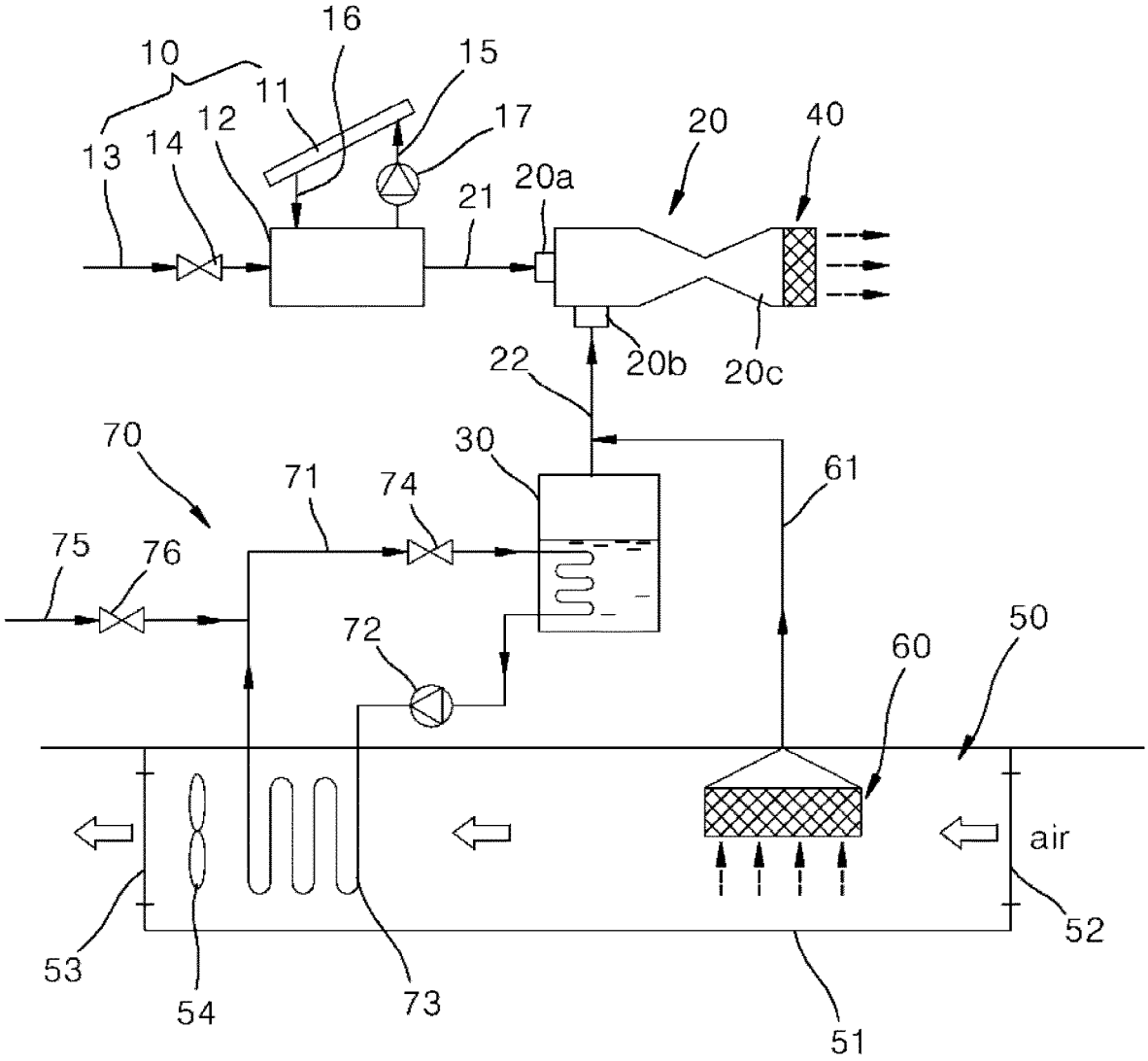
FIG. 2 is a view illustrating an operation of the cooling system using the ejector and the membrane according to the first embodiment of the present invention.

FIG. 2 is a view illustrating an operation of the cooling system using the ejector and the membrane according to the first embodiment of the present invention.

Referring to FIG. 2, the high-temperature and high-pressure steam generated by the steam generating portion 10 is supplied to the ejector 20.

An example in which a temperature of the steam supplied to the ejector 20 is about 60° C. and a pressure thereof is about 20 kPa will be described.

As the high-pressure steam is ejected at high speed inside the ejector 20, a pressure drop is generated inside the ejector 20, and a suction force is generated through the sub-suction port 20*b*.

The water stored in the evaporation chamber 30 is evaporated by the suction force of the ejector 20, and the steam evaporated in the evaporation chamber 30 is sucked into the sub-suction port 20*b* of the ejector 20. A flow rate flowing from the evaporation chamber 30 into the sub-suction port 20*b* of the ejector 20 is about 0.045 g/s.

The moisture ejected through the discharge port 20*c* of the ejector 20 passes through the ejector membrane 40 and is ejected to the outside.

The moisture discharged from the ejector 20 due to a difference in partial pressure of moisture between the front and rear sides of the ejector membrane 40 may pass through the ejector membrane 40 and be ejected to the outside. In this case, an example in which the partial pressure P1 of the moisture discharged from the ejector 20 is about 3.5 kPa and the partial pressure P2 of moisture in the outside air is about 2.5 kPa will be described.

Meanwhile, in the evaporation chamber 30, the refrigerant passing through the evaporation chamber 30 is cooled by evaporation latent heat generated by evaporation of water.

In this case, a pressure inside the evaporation chamber 30 is about 1.25 kPa, and a temperature thereof is about 10° C.

The refrigerant cooled in the evaporation chamber 30 is pumped by the refrigerant pump 72 and passes through the cooling heat exchanger 73.

In the cooling heat exchanger 73, heat exchange between the refrigerant and the indoor air is performed, which will be described in detail later.

Meanwhile, when the blowing fan 54 is operated, the indoor air is sucked into the indoor unit 50 through the intake port 52.

The high-temperature and humid indoor air sucked through the intake port 52 is dehumidified through the indoor dehumidifying membrane 60. The indoor dehumidifying membrane 60 may dehumidify the indoor air by permeating and discharging moisture in the high-temperature and humid indoor air sucked through the intake port 52.

The moisture absorbed by the indoor dehumidifying membrane 60 is sucked into the ejector 20 through the moisture discharge flow path 61.

High-temperature and low-humidity indoor air dehumidified through the indoor dehumidifying membrane 60 is cooled while passing through the cooling heat exchanger 73.

In the cooling heat exchanger 73, heat exchange between the refrigerant cooled in the evaporation chamber 30 and the high-temperature and low-humidity indoor air is performed. Cold air of the refrigerant passing through the cooling heat exchanger 73 may be transferred to the indoor air, and the indoor air may be cooled.

The indoor air cooled while passing through the cooling heat exchanger 73 is discharged back into the room through the exhaust port 53.

The cooling system configured as described above may dehumidify and cool the indoor air using the ejector 20, the ejector membrane 40, the evaporation chamber 30, and the indoor dehumidifying membrane 60.

That is, the coefficient of performance of the cooling system may be improved by cooling the refrigerant using evaporation latent heat generated in the evaporation chamber 30 by the suction force of the ejector 20 and cooling the indoor air using the refrigerant.

In addition, by using solar heat to generate high-temperature and high-pressure steam and supply the generated steam to the ejector 20, energy use efficiency may be improved.

Figure 3:
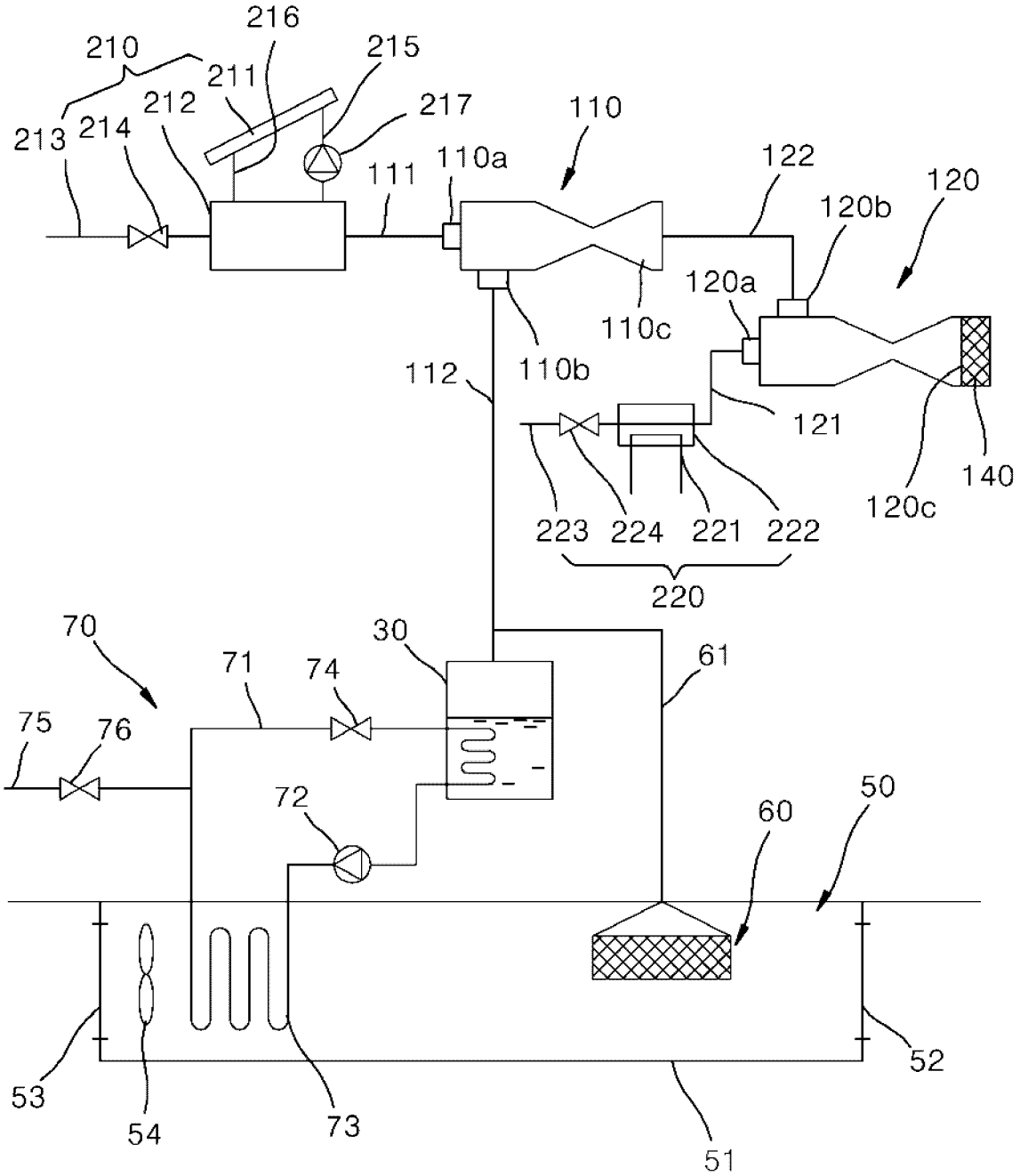
FIG. 3 is a view schematically illustrating a configuration of a cooling system using an ejector and a membrane according to a second embodiment of the present invention.

Meanwhile, FIG. 3 is a view schematically illustrating a configuration of a cooling system using an ejector and a membrane according to a second embodiment of the present invention.

Referring to FIG. 3, since a cooling system using an ejector and a membrane according to a second embodiment of the present invention is different from the first embodiment in that the ejector supplied with the steam from the steam generating portion includes two first and second ejectors 110 and 120, and is similar to the first embodiment in terms of the rest of the configuration and operation, a detailed description of the similar configuration will be omitted, and will be described in detail focusing on different points.

The steam generating portion generates high-pressure steam from an external heat source and supplies the high-pressure steam to the first and second ejectors 110 and 120. The external heat source may include solar heat, geothermal heat, and other heat sources.

In the present embodiment, an example in which the steam generating portion includes a first steam generating portion 210 for supplying the steam to the first ejector 110 and a second steam generating portion 220 for supplying the steam to the second ejector 120 will be described. However, the present invention is not limited thereto, and it is also possible to supply the steam from one steam generating portion to the first ejector 110 and the second ejector 120.

In addition, an example in which the first steam generating portion 210 collects solar heat to generate steam, and the second steam generating 220 generates steam using other heat sources other than solar heat will be described. However, the present invention is not limited thereto, and it is also possible for both the first steam generating portion 210 and the second steam generating portion 220 to generate steam using the same heat source.

An example in which the first steam generating portion 210 is a photovoltaic thermal (PVT) module that generates steam by collecting solar heat will be described.

The first steam generating portion 210 includes a heat collector 211, a first steam drum 212, a first water supply flow path 213, and a first water supply valve 214.

The heat collector 211 is a heat collecting plate that collects solar heat to generate high-temperature and high-pressure steam. The heat collector 211 and the first steam drum 212 are connected by a heat collecting flow path 215 and a heat storage flow path 216.

The heat collecting flow path 215 is a flow path for guiding water stored in the first steam drum 212 to the heat collector 211. The heat storage flow path 216 is a flow path for guiding the steam generated by the heat collector 211 to the first steam drum 212.

A heat collecting pump 217 for pumping the water stored in the first steam drum 212 to the heat collector 211 is installed in the heat collecting flow path 215.

One side of the first steam drum 212 is connected to the first water supply flow path 213, and the other side thereof is connected to a first ejector main suction flow path 111. The steam separated from the first steam drum 212 is sucked into a first main suction port 110*a* of the first ejector 110 through the first ejector main suction flow path 111.

The first water supply flow path 213 is a flow path through which water is supplied from the outside. The first water supply valve 214 is installed in the first water supply flow path 213.

The second steam generating portion 220 includes a heat source supply portion 221, a second steam drum 222, a second water supply flow path 223, and a second water supply valve 224.

One side of the second steam drum 222 is connected to the second water supply flow path 223, and the other side thereof is connected to a second ejector main suction flow path 121. The steam separated from the second steam drum 222 is sucked into a main suction port 120*a* of the second ejector 120 through the second ejector main suction flow path 121.

The second water supply flow path 223 is a flow path through which water is supplied from the outside. The second water supply valve 224 is installed in the second water supply flow path 223.

Meanwhile, the first ejector 110 sucks the steam discharged from the first steam generating portion 210 through the first main suction port 110*a* and ejects the steam at high speed through a first discharge port 110*c*. The first ejector 110 sucks steam evaporated in the evaporation chamber 30 through a first sub-suction port 110*b*.

The first ejector main suction flow path 111 is connected to the first main suction port 110*a* of the first ejector 110, and a first ejector auxiliary suction flow path 112 is connected to the first sub-suction port 110*b* of the first ejector 110.

The first ejector main suction flow path 111 is a flow path that connects the first main suction port 110*a* of the first ejector 110 and the first steam drum 212. The first ejector auxiliary suction flow path 112 is a flow path that connects the first sub-suction port 110*b* of the first ejector 110 and the evaporation chamber 30.

The second ejector 120 sucks the steam discharged from the second steam generating portion 220 through the second main suction port 120*a* and ejects the steam at high speed through a second discharge port 120*c*. The second ejector 120 sucks the steam ejected through the first discharge port 110*c* of the first ejector 110 through the second sub-suction port 120*b*.

The second ejector main suction flow path 121 is connected to the second main suction port 120*a* of the second ejector 120, and a second ejector auxiliary suction flow path 122 is connected to the second sub-suction port 120*b* of the second ejector 120.

The second ejector main suction flow path 121 is a flow path that connects the second main suction port 120*a* of the second ejector 120 and the second steam drum 222. The second ejector auxiliary suction flow path 122 is a flow path that connects the second sub-suction port 120*b* of the second ejector 120 and the first discharge port 110*c* of the first ejector 110.

That is, the first ejector 110 and the second ejector 120 are connected through the second ejector auxiliary suction flow path 122.

Meanwhile, an ejector membrane 140 is installed in the second discharge port 120*c* of the second ejector 120.

The ejector membrane 140 permeates moisture discharged from the second ejector 120 due to a difference in partial pressure of moisture between a discharge side of the second ejector 120 and the outside air and discharges the moisture to the outside air. That is, the moisture may flow from the second ejector 120 in an outside air direction due to a difference in partial pressure of moisture between the front and rear sides of the ejector membrane 140, and may pass through the ejector membrane 140. Any ejector membrane 140 may be used as long as it may permeate the moisture due to a difference in partial pressure of moisture.

An operation of the cooling system using the ejector and the membrane according to the second embodiment of the present invention configured as described above will be described as follows.

Figure 4:
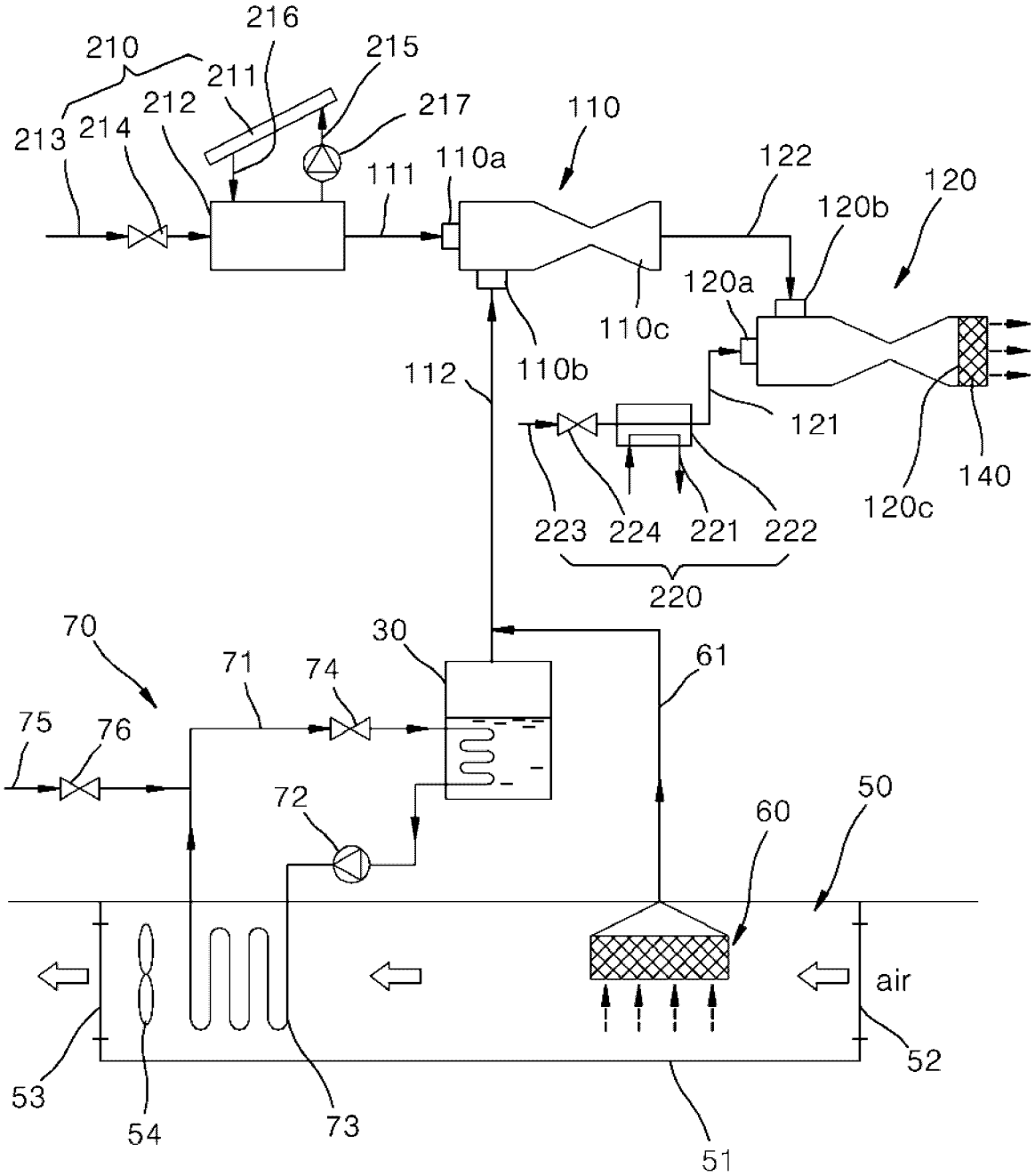
FIG. 4 is a view illustrating an operation of the cooling system using the ejector and the membrane according to the second embodiment of the present invention.

FIG. 4 is a view illustrating an operation of the cooling system using the ejector and the membrane according to the second embodiment of the present invention.

Referring to FIG. 4, the high-temperature and high-pressure steam generated by the first steam generating portion 210 is supplied to the first ejector 110, and the high-temperature and high-pressure steam generated by the second steam generating portion 220 is supplied to the second ejector 120.

In this case, an example in which a temperature of the steam supplied to the first ejector 110 is about 40° C. and a pressure thereof is about 7.4 kPa will be described. In addition, an example in which a temperature of the steam supplied to the second ejector 120 is about 40° C. and a pressure thereof is about 7.4 kPa will be described.

In the second embodiment of the present invention, by using the two first and second ejectors 110 and 120, the temperature of the steam generated by the first and second steam generating portions 210 and 220 may be further lowered. Accordingly, the heat source required by the first and second steam generating portions 210 and 220 may be reduced.

As the high-pressure steam is ejected at high speed inside the first ejector 110, a pressure drop is generated inside the first ejector 110, and a suction force is generated through the first sub-suction port 110*b*.

The water stored in the evaporation chamber 30 is evaporated by the suction force of the first ejector 110, and the steam evaporated in the evaporation chamber 30 is sucked into the first sub-suction port 110*b* of the first ejector 110.

The moisture ejected through the first discharge port 110*c* of the first ejector 110 is sucked into the second sub-suction port 120*b* of the second ejector 120.

As the high-pressure steam is ejected at high speed inside the second ejector 120, a pressure drop is generated inside the second ejector 120, and a suction force is generated through the second sub-suction port 120*b*.

The moisture ejected through the first discharge port 110*c* of the first ejector 110 may be sucked into the second ejector 120 by the suction force of the second ejector 120.

The moisture ejected through the second discharge port 120*c* of the second ejector 120 passes through the ejector membrane 140 and is ejected to the outside.

The moisture discharged from the second ejector 120 due to a difference in partial pressure of moisture between the front and rear sides of the ejector membrane 140 may pass through the ejector membrane 140 and be ejected to the outside. In this case, an example in which the partial pressure P1 of the moisture discharged from the second ejector 120 is about 3.5 kPa and the partial pressure P2 of the moisture in the outside air is about 2.5 kPa will be described.

Meanwhile, in the evaporation chamber 30, the refrigerant passing through the evaporation chamber 30 is cooled by evaporation latent heat generated by evaporation of water.

In this case, a pressure inside the evaporation chamber 30 is about 1.25 kPa, and a temperature thereof is about 10° C.

The refrigerant cooled in the evaporation chamber 30 is pumped by the refrigerant pump 72 and passes through the cooling heat exchanger 73.

In the cooling heat exchanger 73, heat exchange between the refrigerant and the indoor air is performed, which will be described in detail later.

Meanwhile, when the blowing fan 54 is operated, the indoor air is sucked into the indoor unit 50 through the intake port 52.

The high-temperature and humid indoor air sucked through the intake port 52 is dehumidified through the indoor dehumidifying membrane 60.

The moisture absorbed by the indoor dehumidifying membrane 60 is sucked into the ejector 20 through the moisture discharge flow path 61.

High-temperature and low-humidity indoor air dehumidified through the indoor dehumidifying membrane 60 is cooled while passing through the cooling heat exchanger 73.

In the cooling heat exchanger 73, heat exchange between the refrigerant cooled in the evaporation chamber 30 and the high-temperature and low-humidity indoor air is performed. Cold air of the refrigerant passing through the cooling heat exchanger 73 may be transferred to the indoor air, and the indoor air may be cooled.

The indoor air cooled while passing through the cooling heat exchanger 73 is discharged back into the room through the exhaust port 53.

In the cooling system according to the second embodiment of the present invention configured as described above, since the temperature of the steam generated by the steam generating portion may be lower by using the two first and second ejectors 110 and 120, energy use efficiency may be further improved.

The cooling system according to the present invention may dehumidify and cool the indoor air by using the ejector, the ejector membrane, the evaporation chamber, and the indoor dehumidifying membrane.

In addition, the coefficient of performance of the cooling system may be improved by cooling the refrigerant using evaporation latent heat generated in the evaporation chamber by the suction force of the ejector and cooling the indoor air using the refrigerant.

In addition, by using solar heat to generate high-temperature and high-pressure steam and supply the generated steam to the ejector, energy use efficiency may be improved.

In addition, since the temperature of the steam generated in the steam generating portion may be lowered by arranging and using the two first and second ejectors in multiple stages, energy efficiency may be further improved by reducing the consumption of the heat source required for steam generation.

Although the present invention has been described with reference to the embodiments shown in the drawings, which are merely exemplary, it will be understood by those skilled in the art that various modifications and equivalent other embodiments are possible therefrom. Accordingly, the true technical protection scope of the present invention should be defined by the technical spirit of the appended claims.

DETAILED DESCRIPTION OF MAIN ELEMENTS

10: steam generating portion
11: heat collector
12: steam drum
20: ejector
30: evaporation chamber
40: ejector membrane
50: indoor unit
60: indoor dehumidifying membrane
70: cooling heat exchange portion
73: cooling heat exchanger
110: first ejector
120: second ejector
210: first steam generating portion
220: second steam generating portion

What is claimed is:

1. A cooling system using an ejector and a membrane, the cooling system comprising:

a steam generating portion for generating high-pressure steam from an external heat source;

an ejector for sucking the steam discharged from the steam generating portion through a main suction port and ejecting the steam at high speed through a discharge port;

an evaporation chamber connected to a sub-suction port of the ejector, water stored therein being evaporated by a suction force of the ejector and sucked into the sub-suction port;

an ejector membrane provided at the discharge port of the ejector permeated by moisture discharged from the ejector due to a difference in partial pressure of moisture between a discharge side of the ejector and outside air to discharge the moisture to the outside air;

an indoor unit provided in a room and sucking and cooling indoor air;

a cooling heat exchange portion provided between the evaporation chamber and the indoor unit, cooling a refrigerant by performing heat exchange between the refrigerant and water cooled by evaporation latent heat generated in the evaporation chamber, and cooling the indoor air by performing heat exchange between the refrigerant cooled in the evaporation chamber and the indoor air passing through the indoor unit;

a discharge partial pressure sensor for measuring a partial pressure of moisture discharged from the ejector;

an outdoor air sensor for measuring a partial pressure of moisture in the outdoor air; and a control unit for controlling an operation of the steam generating portion so that the partial pressure of the moisture discharged from the ejector exceeds the partial pressure of the moisture in the outside air.

2. The cooling system using an ejector and a membrane of claim 1, further comprising an indoor dehumidifying membrane provided inside the indoor unit to discharge moisture in high-temperature and humid indoor air sucked into the indoor unit to dehumidify the indoor air.

3. The cooling system using an ejector and a membrane of claim 2, further comprising a moisture discharge flow path for guiding the moisture that has permeated the indoor dehumidifying membrane to a discharge side of the evaporation chamber.

4. The cooling system using an ejector and a membrane of claim 1, wherein the steam generating portion includes a heat collector that collects solar heat to generate steam.

5. The cooling system using an ejector and a membrane of claim 1, wherein the cooling heat exchange portion includes:

a refrigerant flow path for guiding the refrigerant to circulate through the evaporation chamber and the indoor unit;

a refrigerant pump provided in the refrigerant flow path to pump the refrigerant cooled by heat exchange in the evaporation chamber;

a cooling heat exchanger provided in the refrigerant flow path and disposed to pass through the indoor unit to transfer cool air of the refrigerant pumped by the refrigerant pump to the indoor air passing through the indoor unit; and a refrigerant valve provided in the refrigerant flow path to control a flow rate of the refrigerant flowing into the evaporation chamber.

6. The cooling system using an ejector and a membrane of claim 5, wherein the indoor unit includes:

a case in which the cooling heat exchanger is disposed;

an intake port formed on one side of the case to suck indoor air;

an exhaust port formed on the other side of the case to discharge air cooled by the cooling heat exchanger into the room; and a blowing fan for sucking the indoor air through the intake port and discharging the indoor air through the exhaust port.

7. The cooling system using an ejector and a membrane of claim 6, further comprising an indoor dehumidifying membrane disposed between the intake port and the cooling heat exchanger inside the case to dehumidify the indoor air by discharging moisture in the high-temperature and humid indoor air flowing into the intake port.

8. The cooling system using an ejector and a membrane of claim 7, further comprising a moisture discharge flow path for guiding moisture that has permeated the indoor dehumidifying membrane to a discharge side of the evaporation chamber.

9. The cooling system using an ejector and a membrane of claim 1, further comprising:

an indoor dehumidifying membrane provided inside the indoor unit to discharge moisture in high-temperature and humid indoor air sucked into the indoor unit to dehumidify the indoor air; and a moisture discharge flow path for guiding the moisture that has permeated the indoor dehumidifying membrane to a sub-suction port of the ejector, wherein the steam generating portion further includes a heat collector that collects solar heat to generate steam, and wherein the cooling heat exchange portion further includes a refrigerant flow path for guiding the refrigerant to circulate through the evaporation chamber and the indoor unit, a refrigerant pump provided in the refrigerant flow path to pump the refrigerant cooled by heat exchange in the evaporation chamber, a cooling heat exchanger provided in the refrigerant flow path and disposed to pass through the indoor unit to transfer cool air of the refrigerant pumped by the refrigerant pump to the indoor air passing through the indoor unit, and a refrigerant valve provided in the refrigerant flow path to control a flow rate of the refrigerant flowing into the evaporation chamber.

10. A cooling system using an ejector and a membrane, the cooling system comprising:

a steam generating portion for generating high-pressure steam from an external heat source;

a first ejector for sucking the steam discharged from the steam generating portion through a first main suction port and ejecting the steam at high speed through a first discharge port;

an evaporation chamber connected to a first sub-suction port of the first ejector, water stored therein being evaporated by a suction force of the first ejector and sucked into the first sub-suction port;

a second ejector for sucking the steam discharged from the steam generating portion through a second main suction port, sucking the steam discharged from the first discharge port of the first ejector through a second sub-suction port, and ejecting the steam at high speed through a second discharge port;

an ejector membrane provided at the second discharge port of the second ejector permeated by moisture discharged from the second ejector due to a difference in partial pressure of moisture between a discharge side of the second ejector and outside air to discharge the moisture to the outside air;

an indoor unit provided in a room and sucking and cooling indoor air; and a cooling heat exchange portion provided between the evaporation chamber and the indoor unit, cooling a refrigerant by performing heat exchange between the refrigerant and water cooled by evaporation latent heat generated in the evaporation chamber, and cooling the indoor air by performing heat exchange between the refrigerant cooled in the evaporation chamber and the indoor air passing through the indoor unit, wherein the external heat source includes at least one of solar heat and geothermal heat, and wherein the steam generating portion includes a first steam generating portion for generating steam from the external heat source and supplying the steam to the first ejector, and a second steam generating portion for generating steam from the external heat source and supplying the steam to the second ejector.

11. The cooling system using an ejector and a membrane of claim 10, further comprising an indoor dehumidifying membrane provided inside the indoor unit to discharge moisture in high-temperature and humid indoor air sucked into the indoor unit to dehumidify the indoor air.

12. The cooling system using an ejector and a membrane of claim 11, further comprising a moisture discharge flow path for guiding the moisture that has permeated the indoor dehumidifying membrane to a discharge side of the evaporation chamber.

13. The cooling system using an ejector and a membrane of claim 10, wherein the steam generating portion includes a heat collector that collects solar heat to generate steam.

14. The cooling system using an ejector and a membrane of claim 10, wherein the cooling heat exchange portion includes:

a refrigerant flow path for guiding the refrigerant to circulate through the evaporation chamber and the indoor unit;

a refrigerant pump provided in the refrigerant flow path to pump the refrigerant cooled by heat exchange in the evaporation chamber;

a cooling heat exchanger provided in the refrigerant flow path and disposed to pass through the indoor unit to transfer cool air of the refrigerant pumped by the refrigerant pump to the indoor air passing through the indoor unit; and a refrigerant valve provided in the refrigerant flow path to control a flow rate of the refrigerant flowing into the evaporation chamber.

15. The cooling system using an ejector and a membrane of claim 14, wherein the indoor unit includes:

a case in which the cooling heat exchanger is disposed;

an intake port formed on one side of the case to suck indoor air;

an exhaust port formed on the other side of the case to discharge air cooled by the cooling heat exchanger into the room; and a blowing fan for sucking the indoor air through the intake port and discharging the indoor air through the exhaust port.

16. The cooling system using an ejector and a membrane of claim 15, further comprising an indoor dehumidifying membrane disposed between the intake port and the cooling heat exchanger inside the case to dehumidify the indoor air by discharging moisture in the high-temperature and humid indoor air flowing into the intake port.

17. The cooling system using an ejector and a membrane of claim 16, further comprising a moisture discharge flow path for guiding moisture that has permeated the indoor dehumidifying membrane to a discharge side of the evaporation chamber.

18. A cooling system using an ejector and a membrane, the cooling system comprising:

a steam generating portion for generating high-pressure steam from an external heat source;

a first ejector for sucking the steam discharged from the steam generating portion through a first main suction port and ejecting the steam at high speed through a first discharge port;

an evaporation chamber connected to a first sub-suction port of the first ejector, water stored therein being evaporated by a suction force of the first ejector and sucked into the first sub-suction port;

a second ejector for sucking the steam discharged from the steam generating portion through a second main suction port, sucking the steam discharged from the first discharge port of the first ejector through a second sub-suction port, and ejecting the steam at high speed through a second discharge port;

an ejector membrane permeated by moisture discharged from the second ejector due to a difference in partial pressure of moisture between a discharge side of the second ejector and outside air to discharge the moisture to the outside air;

an indoor unit provided in a room and sucking and cooling indoor air;

a cooling heat exchange portion provided between the evaporation chamber and the indoor unit, cooling a refrigerant by performing heat exchange between the refrigerant and water cooled by evaporation latent heat generated in the evaporation chamber, and cooling the indoor air by performing heat exchange between the refrigerant cooled in the evaporation chamber and the indoor air passing through the indoor unit;

an indoor dehumidifying membrane provided inside the indoor unit to discharge moisture in high-temperature and humid indoor air sucked into the indoor unit to dehumidify the indoor air; and a moisture discharge flow path for guiding the moisture that has permeated the indoor dehumidifying membrane to a sub-suction port of the first ejector, wherein the steam generating portion includes a heat collector that collects solar heat to generate steam, and the cooling heat exchange portion includes a refrigerant flow path for guiding the refrigerant to circulate through the evaporation chamber and the indoor unit, a refrigerant pump provided in the refrigerant flow path to pump the refrigerant cooled by heat exchange in the evaporation chamber, a cooling heat exchanger provided in the refrigerant flow path and disposed to pass through the indoor unit to transfer cool air of the refrigerant pumped by the refrigerant pump to the indoor air passing through the indoor unit, and a refrigerant valve provided in the refrigerant flow path to control a flow rate of the refrigerant flowing into the evaporation chamber.

* * * * *